US008914183B2

(12) United States Patent
Forwerck et al.

(10) Patent No.: US 8,914,183 B2
(45) Date of Patent: Dec. 16, 2014

(54) ENHANCED ELECTRONIC ASSEMBLY

(76) Inventors: Joshua Forwerck, Royal Oak, MI (US); Charles Still, Clinton, MI (US); William M. Leach, West Bloomfield, MI (US)

( * ) Notice: Subject to any disclaimer, the term of this patent is extended or adjusted under 35 U.S.C. 154(b) by 877 days.

(21) Appl. No.: 12/886,375

(22) Filed: Sep. 20, 2010

(65) Prior Publication Data

US 2012/0072047 A1 Mar. 22, 2012

(51) Int. Cl.

| | |
|---|---|
| ***H01R 12/00*** | (2006.01) |
| ***H01R 12/72*** | (2011.01) |
| *H01R 13/11* | (2006.01) |

(52) U.S. Cl.

CPC ..... *H01R 12/721* (2013.01); *H01R 13/112* (2013.01)

USPC ..... 701/29.1; 439/59; 439/61; 439/249

(58) Field of Classification Search

USPC ..... 439/59, 61, 62, 66, 78, 79, 249

See application file for complete search history.

(56) References Cited

U.S. PATENT DOCUMENTS

| | | | | |
|---|---|---|---|---|
| 3,486,163 | A * | 12/1969 | Dereymaeker et al. | 439/249 |
| 4,799,589 | A * | 1/1989 | Peleckis | 206/716 |
| 5,971,775 | A * | 10/1999 | Tor et al. | 439/79 |
| 6,231,355 | B1 * | 5/2001 | Trammel et al. | 439/79 |
| 6,341,562 | B1 | 1/2002 | Brisighella | |
| 6,488,550 | B1 * | 12/2002 | Kikuchi et al. | 439/857 |
| 6,524,118 | B1 * | 2/2003 | Kikuchi et al. | 439/79 |
| 7,081,011 | B2 * | 7/2006 | Kikuchi et al. | 439/541.5 |
| 7,318,737 | B2 * | 1/2008 | Yokoyama | 439/260 |
| 7,473,585 | B2 | 1/2009 | Brandenburg et al. | |
| 7,500,394 | B2 | 3/2009 | Steele | |
| 7,722,404 | B2 * | 5/2010 | Neumetzler | 439/636 |
| 7,740,273 | B2 | 6/2010 | Breed | |
| 8,277,262 | B2 * | 10/2012 | Busse | 439/719 |
| 2008/0084005 | A1 * | 4/2008 | Steele et al. | 264/272.14 |
| 2008/0110739 | A1 | 5/2008 | Peng et al. | |
| 2008/0284145 | A1 | 11/2008 | Breed | |

FOREIGN PATENT DOCUMENTS

| | | | |
|---|---|---|---|
| DE | 102008022973 | A1 | 11/2009 |
| WO | WO2010014550 | A2 | 2/2010 |

* cited by examiner

*Primary Examiner* — Thomas G Black
*Assistant Examiner* — Peter D Nolan
(74) *Attorney, Agent, or Firm* — Brinks Gilson & Lione

(57) ABSTRACT

Remote sensor units for a vehicle are described. An apparatus may comprise a satellite housing having an electrical connector interface portion, and an electrical connector disposed within the electrical connector interface portion of the satellite housing. The electrical connector may be arranged to conduct electrical signals for an electronic component having an electronic sensor operative to monitor conditions for a vehicle, the electrical connector comprising a capture portion at a first end and a pin portion at a second end, the capture portion having a pair of opposing mechanical contact elements arranged to receive at least one edge of the electronic component. Other embodiments are described and claimed.

19 Claims, 15 Drawing Sheets

*Remote Sensor Unit 800*

Remote Sensor Unit 800

Remote Sensor Unit 800

ENHANCED ELECTRONIC ASSEMBLY

BACKGROUND

A vehicle safety system typically relies upon a host of electronic sensors designed to monitor and provide data about certain conditions for the vehicle. For instance, an impact detection system may use various types of impact sensors to provide data to an airbag control unit which calculates an angle of impact, severity and force of an impact to determine whether to deploy one or more airbag stages. To improve performance, the electronic sensors are positioned around various portions of a vehicle to optimize sensing capabilities and coverage. However, some areas of a vehicle place increasing operational demands on electronic sensors, oftentimes exposing electronic sensors to harsh environmental conditions. As such, electronic sensors are typically contained within some form of protective housing, collectively referred to sometimes as an electronics package.

As the electronics industry migrates to new processes and technologies, available electronic packages are becoming smaller. While the reduction in size has advantages, such as placement of electronic sensors throughout tight spaces in a vehicle, it also introduces new concerns and precautions. Reductions in size make it more difficult to manufacture or insert an electronic sensor within a corresponding protective housing. Further, the smaller electronic packages generally have smaller contact pads which result in a reduction in connection area between an electronic sensor, such as mounted on a printed circuit board (PCB), and an interface used to electrically connect the PCB to a vehicle system. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In one embodiment, an apparatus such as a remote sensor unit (RSU) may comprise a satellite housing having an electrical connector interface portion. The RSU may have an electrical connector disposed within the electrical connector interface portion of the satellite housing. The electrical connector may be arranged to conduct electrical signals for an electronic component having an electronic sensor operative to monitor conditions for a vehicle, for example. The electrical connector may comprise a capture portion at a first end and a pin portion at a second end. The capture portion may have a pair of opposing mechanical contact elements arranged to receive at least one edge of the electronic component. At least one of the opposing mechanical contact elements may comprise an electrical contact element to contact and electrically connect to an electrical contact element formed on a surface of the electronic component. The pin portion may have an electrical contact element to contact and electrically connect to a communications medium for a vehicle monitoring system. Other embodiments are described and claimed.

These and other features and advantages will be apparent from a reading of the following detailed description and a review of the associated drawings. It is to be understood that both the foregoing general description and the following detailed description are explanatory only and are not restrictive of aspects as claimed.

DETAILED DESCRIPTION

Figure 1:
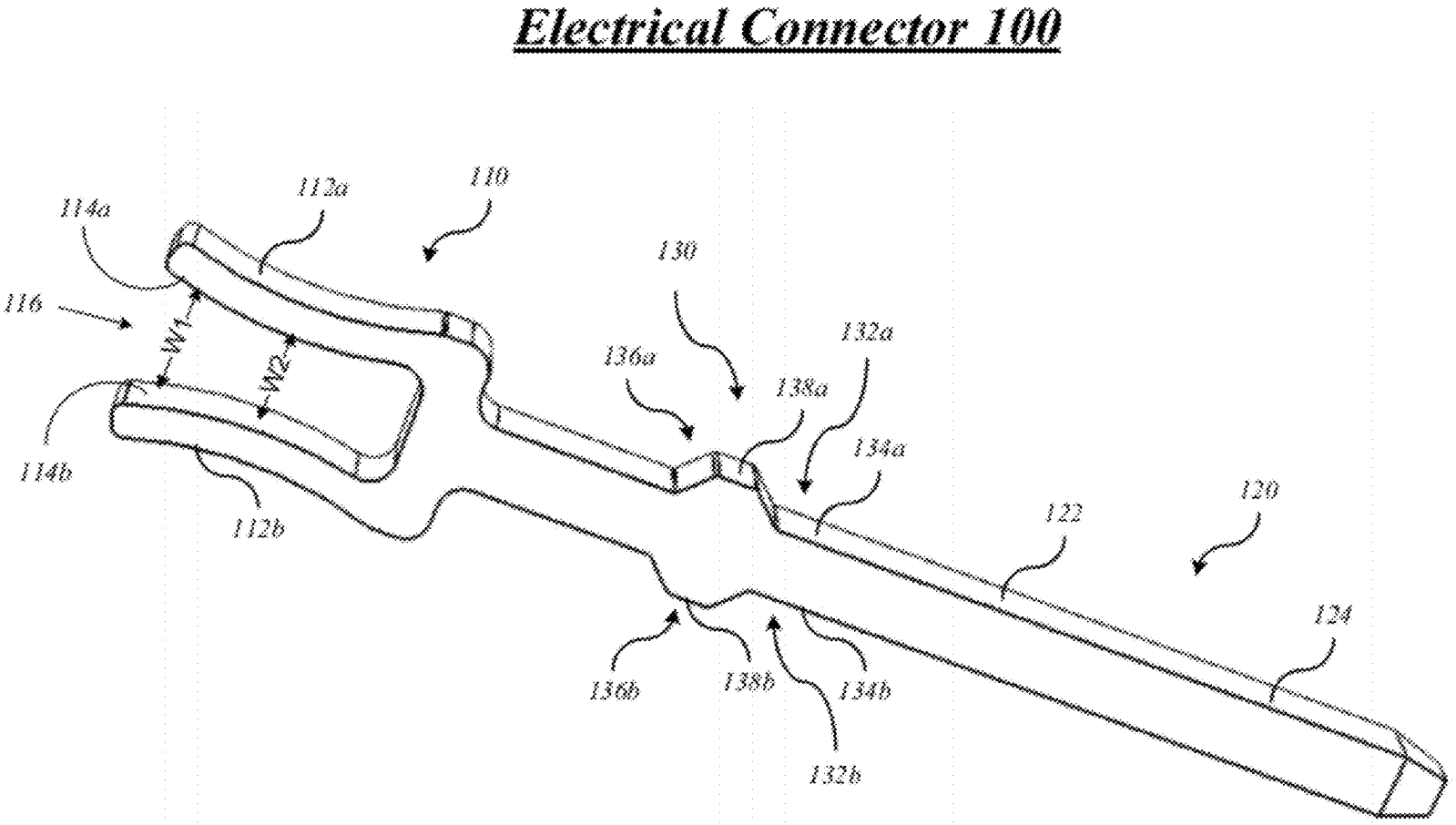
FIG. 1 illustrates a perspective view of a first electrical connector.

Various embodiments are generally directed to electronic packages suitable for use with a device or system. Some embodiments may be particularly directed to electronic packages suitable for use with a motor vehicle. An electronic package may include some form of an electronic component and a satellite housing. An electronic component may comprise, for example, an electronic sensor mounted on a PCB. A satellite housing is some form of a protective enclosure having an aperture, fitting or interface suitable to receive and retain the electronic component. A satellite housing may conform to any number of defined package geometries. For instance, defined package geometries may be specified by a unique customer, industry standard, or general product offering. Once the electronic component is fitted within the appropriate satellite housing, an electronic package may be formed that is able to withstand harsher environmental conditions that normally would cause damage or malfunctioning of the electronic component. In this manner, the electronic component may provide superior performance and durability throughout the expected life-cycle of the electronic component.

Some embodiments are particularly directed to an electronic package configured as an enhanced remote sensor unit (RSU) for a vehicle monitoring system implemented for a motor vehicle. A vehicle monitoring system may comprise any electronic system using one or more remote sensors to collect information about a motor vehicle. Examples of vehicle monitoring systems may include without limitation vehicle safety systems, vehicle performance systems, vehicle control systems, vehicle testing systems, and any other vehicle monitoring systems suitable for use with electronic sensors. The embodiments are not limited in this context.

In one embodiment, for example, a vehicle monitoring system may include a vehicle safety system. Vehicle safety systems may include both active and passive safety devices and systems. Examples of vehicle safety systems may include crash avoidance systems, driver assistance systems, crash detection or crashworthiness systems, and other vehicle safety systems. It may be appreciated that various embodiments for an enhanced remote sensor unit may be used with other vehicle monitoring systems as well. The embodiments are not limited in this context.

In one embodiment, an enhanced RSU may comprise a satellite housing having an electrical connector interface portion. The RSU may have an electrical connector disposed within the electrical connector interface portion of the satellite housing. The electrical connector may be arranged to conduct electrical signals for an electronic component having an electronic sensor operative to monitor conditions for a vehicle, for example. The electrical connector may comprise a capture portion at a first end and a pin portion at a second end. The capture portion may have a pair of opposing mechanical contact elements arranged to receive at least one edge of the electronic component. In one embodiment, for example, the capture portion may be arranged to capture a front edge of an electronic component. In one embodiment, for example, the capture portion may be arranged to capture one or more side edges of an electronic component. At least one of the opposing mechanical contact elements may comprise an electrical contact element to contact and electrically connect to an electrical contact element formed on a surface of the electronic component. The pin portion may have an electrical contact element to contact and electrically connect to a communications medium for a vehicle monitoring system.

An electrical connector having innovative capture portions for an electronic component may provide several advantages over conventional connectors. For instance, an electrical connector may be disposed within a satellite housing before, during or after manufacture of the satellite housing. This allows flexibility in selecting trade-offs for design, manufacturing and assembly processes associated with an electrical connector for a RSU. In another example, an electronic component may be attached to a capture portion of an electrical connector to form an electronic assembly before or after the electrical connector is disposed within the satellite housing. Furthermore, different sides of an electronic component may be attached to different capture portions of an electrical connector to form an electronic assembly before or after the electrical connector is disposed within the satellite housing. This allows further flexibility in selecting trade-offs for design, manufacturing and assembly processes associated with an electronic assembly for a RSU. Other advantages exist as described further below.

FIG. 1 illustrates a perspective view of an electrical connector 100. The electrical connector 100 may be implemented as part of an enhanced RSU comprising a satellite housing having an electrical connector interface portion. In one embodiment, the enhanced RSU may have the electrical connector 100 disposed within the electrical connector interface portion of the satellite housing. An exemplary satellite housing may be described in more detail with reference to FIG. 5.

In various embodiments, the electrical connector 100 may be arranged to conduct electrical signals for an electronic component having an electronic sensor operative to monitor conditions for a vehicle. In the illustrated embodiment shown in FIG. 1, the electrical connector 100 may comprise a capture portion 110 at a first end, a pin portion 120 at a second end, and a housing interface portion 130 connecting the capture portion 110 and the pin portion 120.

As shown, the capture portion 110 may have a pair of opposing mechanical contact elements 112*a*, 112*b* arranged to receive at least one edge of an electronic component. In one embodiment, the pair of opposing mechanical contact elements 112*a*, 112*b* may be formed with curved surfaces adapted to receiving an edge of an electronic component. For example, the opposing mechanical contact element 112*a* may have a first curved surface and the opposing mechanical contact element 112*b* may have a second curved surface, with the first and second curved surfaces curving away from each other. One or both of the opposing mechanical contact elements 112*a*, 112*b* may comprise respective electrical contact elements 114*a*, 114*b* to contact and electrically connect to an electrical contact element formed on a surface of an electronic component.

In one embodiment, the pair of opposing mechanical contact elements 112*a*, 112*b* may be formed with curved surfaces adapted to receive an edge of an electronic component. The curved surfaces may be sized a sufficient distance apart to form a gap 116 having a first gap width W1 which is slightly larger than a width W3 for a given edge at an initial portion of the curved surfaces, and a second gap width W2 that is slightly narrower than the width W3 for the given edge towards a center portion of the curved surfaces. In this manner, the pair of opposing mechanical contact elements 112*a*, 112*b* at the first gap width W1 may be sufficiently spaced to receive and guide an edge of an electronic component as it is being inserted into the capture portion 110, while the second gap width W2 provides sufficient force to retain the edge once it has been fully seated into the capture portion 110.

The pin portion 120 may have an electrical contact element 124 to contact and electrically connect to a communications medium for a vehicle monitoring system. In one embodiment, the pin portion 120 may comprise a pin 122 having the electrical contact element 124 to contact and electrically connect to an electrical contact element for a vehicle monitoring system.

The housing interface portion 130 connects the capture portion 110 and the pin portion 120. In one embodiment, the housing interface portion 130 may comprise a first side 132*a* having a first side surface 134*a* and a second side 132*b* having a second side surface 134*b*. The first side 132*a* may have a first extension 136*a* with a first extension surface 138*a* in a different plane from the first side surface 134*a*, and the second side 132*b* may have a second extension 136*b* with a second extension surface 138*b* in a different plane from the second side surface 134*b*. In one embodiment, the housing interface portion 130 may be formed within a corresponding electrical connector interface portion of a satellite housing, and the extensions 136*a*, 136*b* may provide enhanced mechanical stability for the electrical connector 100.

Figure 2:
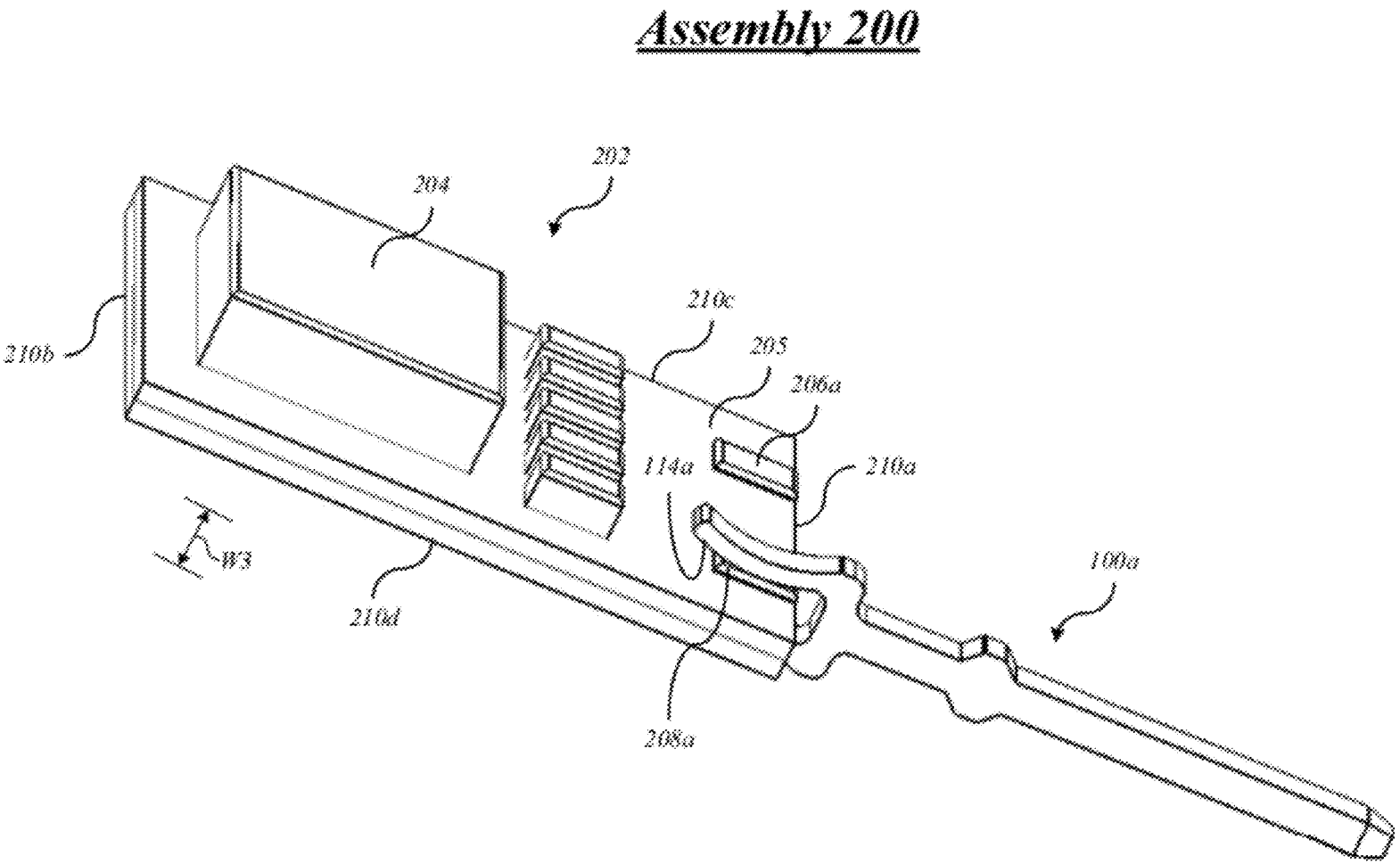
FIG. 2 illustrates a first perspective view of a first electronic assembly.

FIG. 2 illustrates a perspective view of a top portion of an electronic assembly 200. The electronic assembly 200 may comprise the electrical connector 100 connected to an electronic component 202. As shown, the electronic component 202 may comprise an electronic sensor 204 arranged to monitor various conditions for a vehicle and output data signals to a vehicle safety system. The electronic component 202 may further comprise one or more electrical contact elements 206,

208 (up to n electrical contact elements) coupled to the electronic sensor 204. Although various embodiments may describe the electronic component 202 as including the electronic sensor 204 by way of example and not limitation, it may be appreciated that the electronic component 202 may comprise any electrical or electronic elements suitable for a given device or system. The embodiments are not limited in this context.

The electronic component 202 may comprise a substrate 205 with the electronic sensor 204 mounted on either side of the substrate 205. The electronic sensor 204 may comprise, or be implemented as, one or more circuit components, such as a processor, a memory, a transceiver, and so forth. Other circuit components may include power circuits, filters, capacitors and other circuit elements suitable for implementing the electronic component 202 and/or the electronic sensor 204. The electronic sensor 204 and its constituent parts may be implemented as one or more integrated circuits (ICs) mounted on one or both sides of the substrate 205. It may be appreciated that the electronic sensor 204 may be implemented with any number of circuit components as desired for a given implementation.

The electronic sensor 204 may be arranged to monitor various conditions for a vehicle and output data signals to a vehicle safety system. Examples for the electronic sensor 204 may comprise without limitation an accelerometer, a decelerometer, an impact (crash) sensor, pressure sensor, a wheel speed sensor, a brake pressure sensor, a seat occupancy sensor, a crush zone sensor, a gyroscope, temperature sensor, and any other electronic sensor capable of providing useful information for a vehicle safety system. An accelerometer monitors and measures the acceleration of a vehicle. A decelerometer monitors and measures the deceleration of a vehicle. An impact sensor monitors and measures impact magnitude at a point of impact of a vehicle. A pressure sensor monitors and measures the pressure on the vehicle at the point of impact relative to the normal pressure on the vehicle. A wheel speed sensor or vehicle speed sensor (VSS) is a type of tachometer used for reading the speed of a vehicle's wheel rotation. Wheel speed sensors are used, for example, in anti-lock braking systems. A brake pressure sensor monitors and measures an amount of brake pressure applied to a brake or braking system. A seat occupancy sensor monitors and measures a weight placed on a seat to determine whether a person is sitting in the seat. A seat occupancy sensor may be used to determine whether to deploy an airbag, activate seatbelt pretensioners and other occupancy restraint systems, and so forth. A crush zone sensor measures the amount a vehicle has been crushed or deformed through contact with other objects during a dynamic crash event. A gyroscope measures the rotation of the vehicle to maintain orientation. In various embodiments, the electronic sensor 204 may be implemented as one or more of the sensors described above, or a combination of any of the sensors described above. Other types of electronic sensors may be implemented for the electronic sensor 204 as well. The embodiments are not limited in this context.

The substrate 205 may comprise any known material suitable for receiving an electronic circuit. In one embodiment, for example, the substrate 205 may comprise a printed circuit board (PCB). The PCB may comprise materials such as FR4, Rogers R04003, Kapton, and/or Roger RT/Duroid, for example, and may include one or more conductive traces, via structures, and/or laminates. The PCB also may include a finish such as Gold, Nickel, Tin, or Lead. In various implementations, the PCB may be fabricated using processes such as etching, bonding, drilling, and plating. In some cases, a conductive epoxy may be utilized for various attachments to the substrate 205.

The substrate 205 may comprise a single-sided substrate or a double-sided substrate. The substrate 205 may support single-sided or double-sided population, as well as multilayer designs (e.g., 2 layer, 4 layer, and so forth). The substrate 205 may include one or more electrical contact elements 206, 208 implemented for the electronic component 202. In one embodiment, for example, the substrate 205 may comprise a double-sided substrate having a first electrical contact element 206*a* disposed on a first side of the substrate 205, and a second electrical connector 206*b* disposed on a second side of the substrate 205. Similarly, the substrate 205 may have a first electrical contact element 208*a* disposed on a first side of the substrate 205, and a second electrical connector 208*b* disposed on a second side of the substrate 205. It may be appreciated that the electronic component 202 can have any number of electrical contact elements 206, 208 as desired for a given implementation.

The electrical contact elements 206, 208 may be connected to one or more electrical connectors 100 to convey electrical signals to an external device, such as an electrical interconnect or wiring harness for a vehicle safety system. FIG. 2 illustrates a single electrical connector 100 connected to the electrical contact elements 208*a*, 208*b* for clarity and not limitation.

As shown in FIG. 2, the capture portion 110 of the electrical connector 100 may have a pair of opposing mechanical contact elements 112*a*, 112*b* arranged to receive at least one edge 210*a*, 210*b*, 210*c* or 210*d* of the electronic component 202. By way of example and not limitation, FIG. 2 illustrates the capture portion 110 receiving a front edge 210*a* of the electronic component 202.

In one embodiment, the pair of opposing mechanical contact elements 112*a*, 112*b* may be formed with curved surfaces adapted to receiving an edge 210*a*, 210*b*, 210*c* or 210*d* of the electronic component 202. The curved surfaces may be sized a sufficient distance apart to form a gap 116 having a first gap width W1 which is slightly larger than a width W3 for an edge 210*a*, 210*b*, 210*c* or 210*d* at an initial portion of the curved surfaces, and a second gap width W2 that is slightly narrower than the width W3 for an edge 210*a*, 210*b*, 210*c* or 210*d* towards a center portion of the curved surfaces. In this manner, the pair of opposing mechanical contact elements 112*a*, 112*b* at the first gap width W1 may be sufficiently spaced to receive and guide an edge 210*a*, 210*b*, 210*c* or 210*d* of the electronic component 202 as it is being inserted into the capture portion 110, while the second gap width W2 provides sufficient force to retain an edge 210*a*, 210*b*, 210*c* or 210*d* of the electronic component 202 once it has been fully seated into the capture portion 110. The force should be enough to allow the electrical contact elements 114*a*, 114*b* of the electrical connector 110 to maintain contact and electrically connect to the electrical contact elements 206, 208 formed on a surface of the substrate 204 of the electronic component 202.

Figure 3:
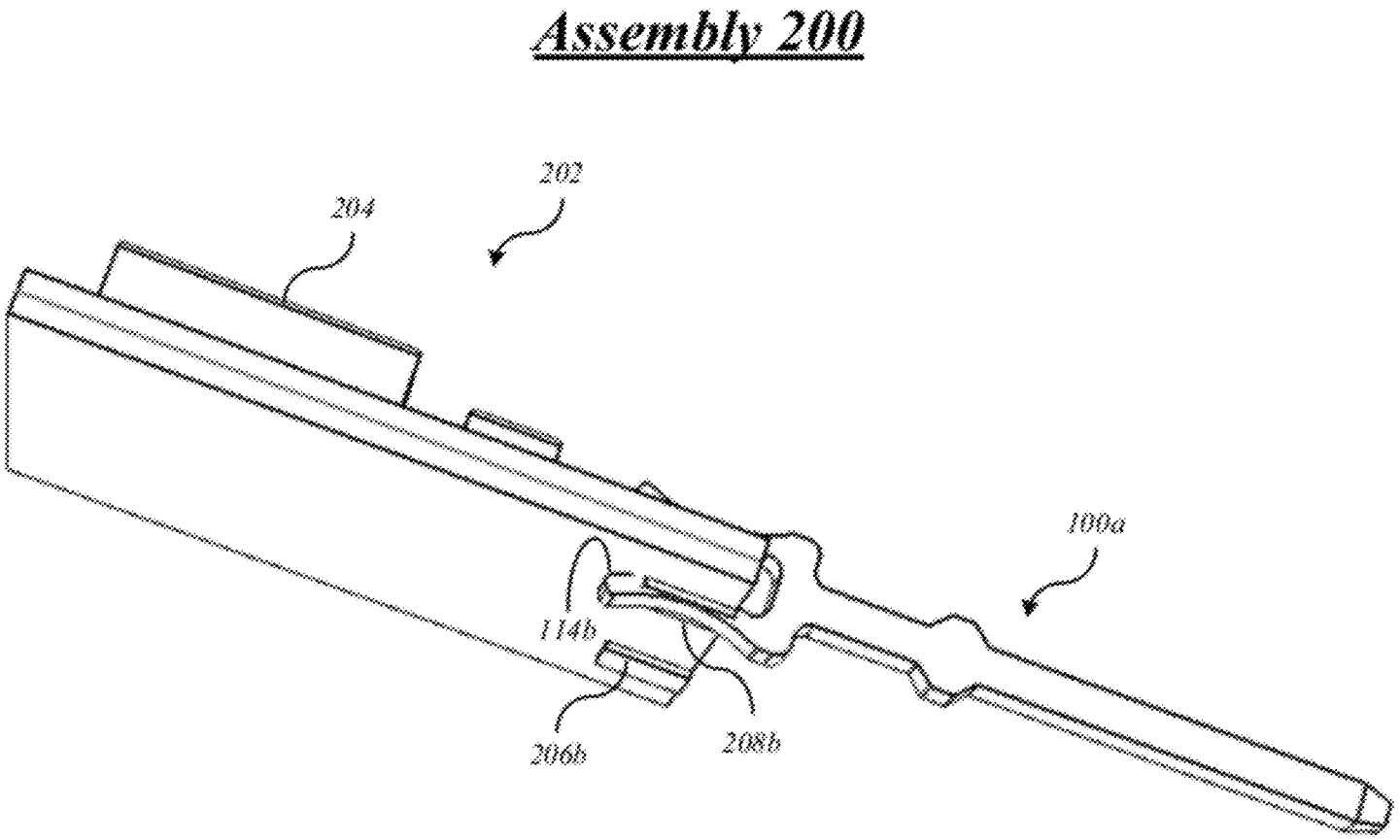
FIG. 3 illustrates a second perspective view of the first electronic assembly.

FIG. 3 illustrates a perspective view of a bottom portion of the electronic assembly 200. The bottom portion of the substrate 205 of the electronic component 202 may include electrical contact elements 206*b*, 208*b* corresponding to the electrical contact elements 206*a*, 208*a* shown in FIG. 2. As shown in FIG. 3, the electrical contact element 114*b* of the mechanical contact element 112*b* of the electrical connector 100 may contact the electrical contact element 208*b* when an edge 210*a*, 210*b*, 210*c* or 210*d* is fully inserted into the capture portion 110 of the electrical connector 100.

Figure 4:
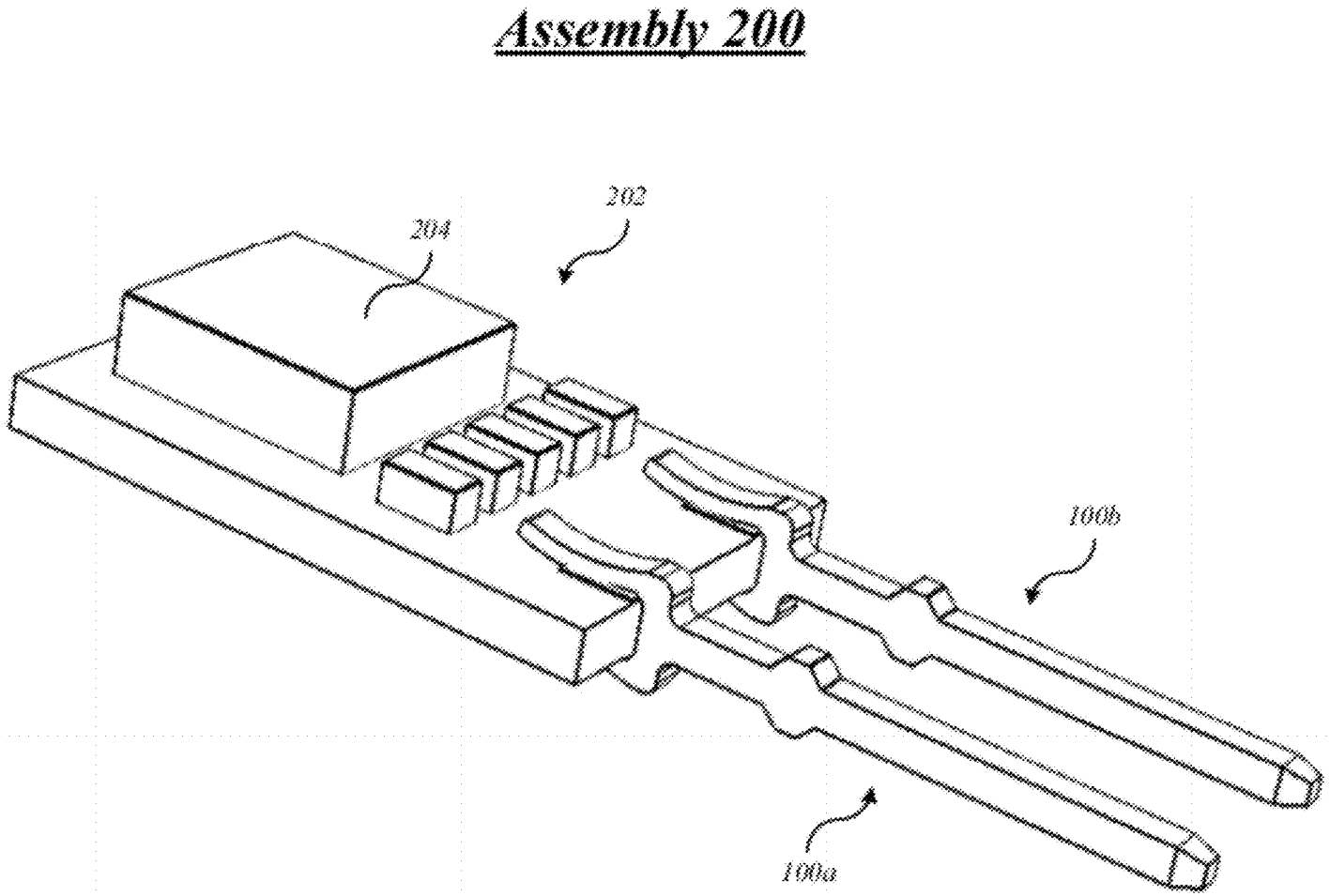
FIG. 4 illustrates a third perspective view of the first electronic assembly.

FIG. 4 illustrates another perspective view of a top portion of an electronic assembly 200. In the illustrated embodiment shown in FIG. 4, the electronic assembly 200 has a pair of electrical connectors 100*a*, 100*b*, each electrically connected to the electronic component 202 via the electrical contact elements 206, 208. Although FIG. 4 illustrates two electrical connectors 100*a*, 100*b*, it may be appreciated that any number of electrical connectors 100 and corresponding electrical contact elements 206, 208 may be implemented for a given set of design and performance constraints. The embodiments are not limited in this context.

Figure 5:
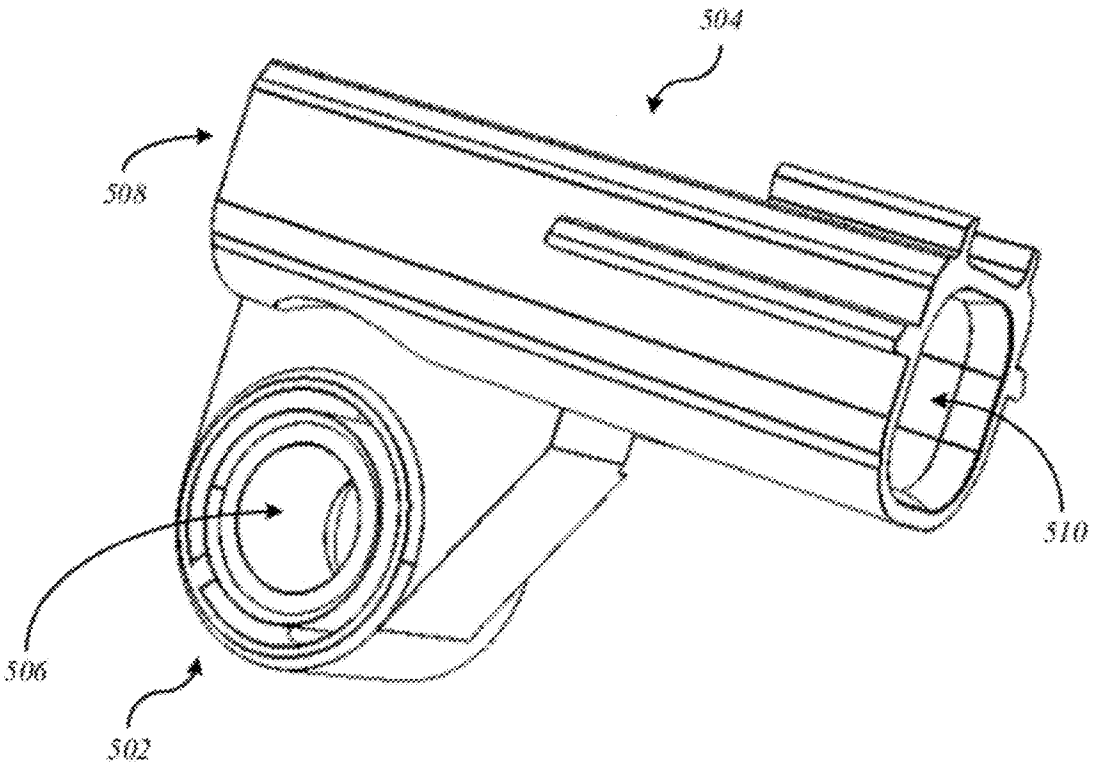
FIG. 5 illustrates a side perspective view of satellite housing.

FIG. 5 illustrates a side perspective view of an exemplary satellite housing 500. The satellite housing 500 may be arranged to encapsulate the electronic assembly 200 while exposing the pin portions 120*a*, 120*b* of the respective electrical connectors 100*a*, 100*b* for interconnection to a wiring harness for a vehicle safety system.

The satellite housing 500 is generally arranged to isolate the electronic component 202 from thermal energy, pressure, residual material stress, mechanical stress or other harsh environmental conditions associated with an operating environment for the satellite housing when fastened to a vehicle. In some embodiments, the satellite housing 500 may be formed using an injection molding manufacturing process. Molding material for the satellite housing 500 may generally comprise any thermoplastic or thermosetting plastic materials suitable for an injection molding manufacturing process to create the satellite housing 500. In some embodiments, the molding material may be selected from a class of harder materials capable of withstanding higher temperatures and pressures typically found in an operating environment for a motor vehicle. The satellite housing 500 may be formed from any suitable type of materials, including various synthetic polymers such as PBT, LCP or Nylon. Other suitable materials may comprise a metal or metallic alloy. A particular material for a given implementation may be selected based on a particular operating environment, and should have structural properties to ensure adequate protection for the electronic assembly 200 and sufficient to maintain a fastening load over a life-cycle for a remote sensing unit. Further, the selected material should be sufficiently strong to prevent deformation during a dynamic crash event. The embodiments are not limited in this context.

The satellite housing 500 may be formed in any shape or geometry needed for a given implementation, including standard industry fasteners and interconnects. The satellite housing 500 may be formed in different sizes, shapes, geometries or form factors suitable for mounting a remote sensor unit on a vehicle, and also for interconnecting to a vehicle safety system. In one embodiment, for example, the satellite housing 500 may be manufactured or formed as part of the vehicle part, and the electronic assembly 100 may be inserted into the satellite housing 500 formed in a given vehicle part or component. Suitable vehicle parts may include without limitation vehicle frames, supports, brackets, assemblies or other appropriate structures or components for a vehicle. The embodiments are not limited in this context.

In the illustrated embodiment shown in FIG. 5, the satellite housing 500 may include a fastener portion 502 and an interface portion 504. The fastener portion 502 may be formed in a shape to fasten to a vehicle, and may be insert molded at the same time as the satellite housing 500 is molded. The fastener portion 502 may have an aperture 506 for receiving a post, bolt or other fastener suitable for mounting the satellite housing 500 to a vehicle. The interface portion 504 may be formed to interconnect to a vehicle safety system. It may be appreciated that the satellite housing 500 in general may have any number of interfaces specifically designed for vehicle applications, and that the fastener portion 502 and the interface portion 504 may have any size, shape or geometry suitable for corresponding mating connectors. The embodiments are not limited in this context.

The interface portion 504 may have an aperture 508 arranged to expose the capture portions 110*a*, 110*b* of the respective electrical connectors 100*a*, 100*b*. The interface portion 504 may be formed to interconnect to the electronic component 202. For example, the interface portion 504 may have the aperture 508 with capture portions 110*a*, 110*b* of the respective electrical connectors 100*a*, 100*b* exposed for electrical connection to the electronic component 202. The aperture 508 protects the capture portions 110*a*, 110*b*, while providing a fitting for a mating connector used by a given electronic component 202. It may be appreciated that the aperture 508 of the interface portion 504 may have any size, shape or geometry suitable for corresponding electronic components and associated mating connectors. The embodiments are not limited in this context.

The interface portion 504 may also have an aperture 510 arranged to expose the pin portions 120*a*, 120*b* of the respective electrical connectors 100*a*, 100*b*. The interface portion 504 may be formed to interconnect to a vehicle safety system. For example, the interface portion 504 may have the aperture 510 with pin portions 120*a*, 120*b* of the respective electrical connectors 100*a*, 100*b* exposed for electrical connection to a communication media for a vehicle safety system. The aperture 510 protects the pin portions 120*a*, 120*b*, while providing a fitting for a mating connector used by a given vehicle safety system. It may be appreciated that the aperture 510 of the interface portion 504 may have any size, shape or geometry suitable for corresponding mating connectors. The embodiments are not limited in this context.

Figure 6:
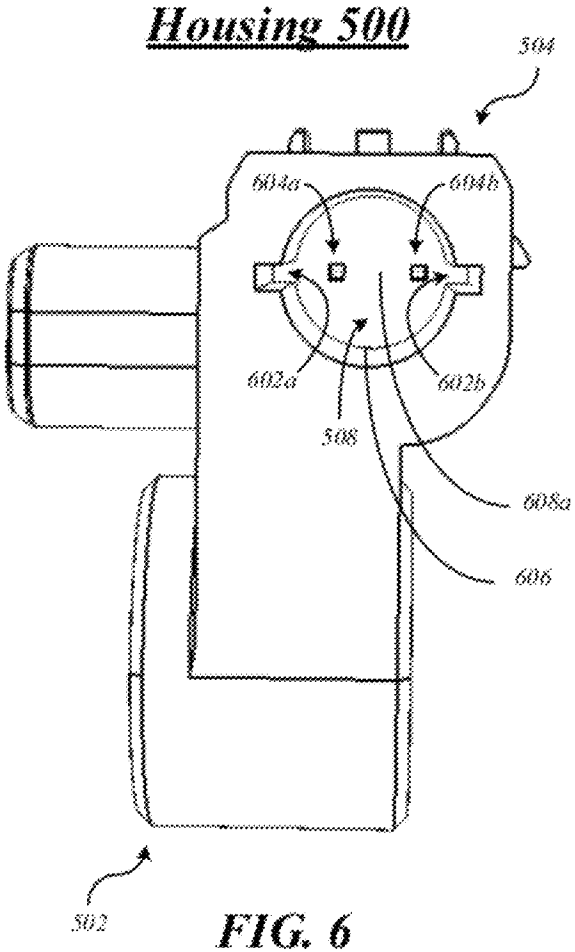
FIG. 6 illustrates a rear perspective view of satellite housing.

FIG. 6 illustrates a rear perspective view of the satellite housing 500 showing more detail for the aperture 508. As shown, the aperture 508 may form a roughly cylindrical shape with a pair of opposing notches 602*a*, 602*b*. The opposing notches 602*a*, 602*b* may be sized to receive a pair of side edges 210*c*, 210*d* of the electronic component 202 as shown in FIG. 2. The pair of opposing notches 602*a*, 602*b* may be oriented to guide the electronic component 202 in an axial direction aligned with an axis for the pin portions 120*a*, 120*b* to allow the front edge 210*a* of the electronic component 202 to enter gaps 116*a*, 116*b* formed between the pair of opposing mechanical contact elements 112*a*, 112*b* for each of the capture portions 120*a*, 120*b* when forced is applied to a back edge 210*b* of the electronic component 202.

The aperture 508 of the satellite housing 500 may further show one side 608*a* of an electrical connector interface portion 606 for the satellite housing 500. In various embodiments, the electrical connector interface portion 606 may comprise a portion of the satellite housing 500 arranged to hold or encapsulate a portion of the electrical connector 100, such as the housing interface portion 130 connecting the capture portion 110 and the pin portion 120 of the electrical connector 100.

In one embodiment, the electrical connector interface portion 606 of the satellite housing 500 may encapsulate the housing interface portion 130 of the electrical connector 100 when the satellite housing 500 is created. For example, the electrical connector interface portion 606 may be arranged to encapsulate the housing interface portion 130 during manufacture of the satellite housing 500. The satellite housing 500 may be formed using an injection molding manufacturing process. During the injection molding manufacturing process, the electrical connector interface portion 606 of the satellite housing 500 may be formed around the housing interface portion 130 of the electrical connector 100. The electrical connector 100 may be placed in a mold used to form the satellite housing 500, and positioned so that the molding material used to form the satellite housing 500 completely encapsulates (or overmolds) the housing interface portion 130 of the electrical connector 100. When the electrical connection interface portion 606 is fully formed around the housing interface portion 130 and hardens to a finished product, the extensions 136*a*, 136*b* of the housing interface portion 130 may become embedded within the electrical connection interface portion 606 to provide enhanced mechanical stability for the electrical connector 100. It is worthy to note that the satellite housing 500 as shown in FIG. 6 illustrates the satellite housing 500 as it would look without the electrical connectors 100*a*, 100*b*, and rather has a pair of apertures 604*a*, 604*b* indicating respective positions for the electrical connectors 100*a*, 100*b* inserted before, during or after manufacture of the satellite housing 500.

Alternatively, the electrical connector interface portion 606 may be arranged to guide and hold the housing interface portion 130 after manufacture of the satellite housing 500. The electrical connector interface portion 606 may be formed with the pair of apertures 604*a*, 604*b* having a geometry matching the pin portions 120*a*, 120*b* of the electrical connectors 100*a*, 100*b*. In this embodiment, the electrical connector 100 may be formed without the extensions 136*a*, 136*b* of the housing interface portion 130 (similar to electrical connector 1200 illustrated and described with reference to FIG. 12), thereby allowing the pin portions 120*a*, 120*b* of the respective electrical connectors 100*a*, 100*b* to be inserted into the respective apertures 604*a*, 604*b*.

In various embodiments, the apertures 604*a*, 604*b* may have a size and geometry matching the pin portions 120*a*, 120*b* of the respective electrical connectors 100*a*, 100*b* to allow the apertures 604*a*, 604*b* to receive the pin portions 120*a*, 120*b* when force is applied to the capture portions 110*a*, 110*b* of the electrical connectors 100*a*, 100*b*. The apertures 604*a*, 604*b* may be designed with several tolerances that need to be tightly controlled to ensure a robust electrical connection. The parameters may include without limitation parameters associated with the electronic component 202, such as aperture size, aperture location, plating thickness, plating quality, and so forth. The parameters may further include without limitation parameters associated with the electrical connectors 100*a*, 100*b*, such as material hardness, contact surface plating, contact surface texture (e.g., stamping burs, plating irregularities, etc.), and so forth. The parameters may include without limitation parameters associated with the satellite housing 500, such as terminal position/location, board insertion guides (e.g., location features), material shrinkage and/or warping, and so forth. As with any design and manufacturing process, the addition of controls and inspections increases cost. This cost can be measured in process time, equipment cost, and scrap. This cost may be weighed against the benefits of allowing the electrical connectors 100*a*, 100*b* to be inserted into the satellite housing 500 after it has been manufactured.

Figure 7:
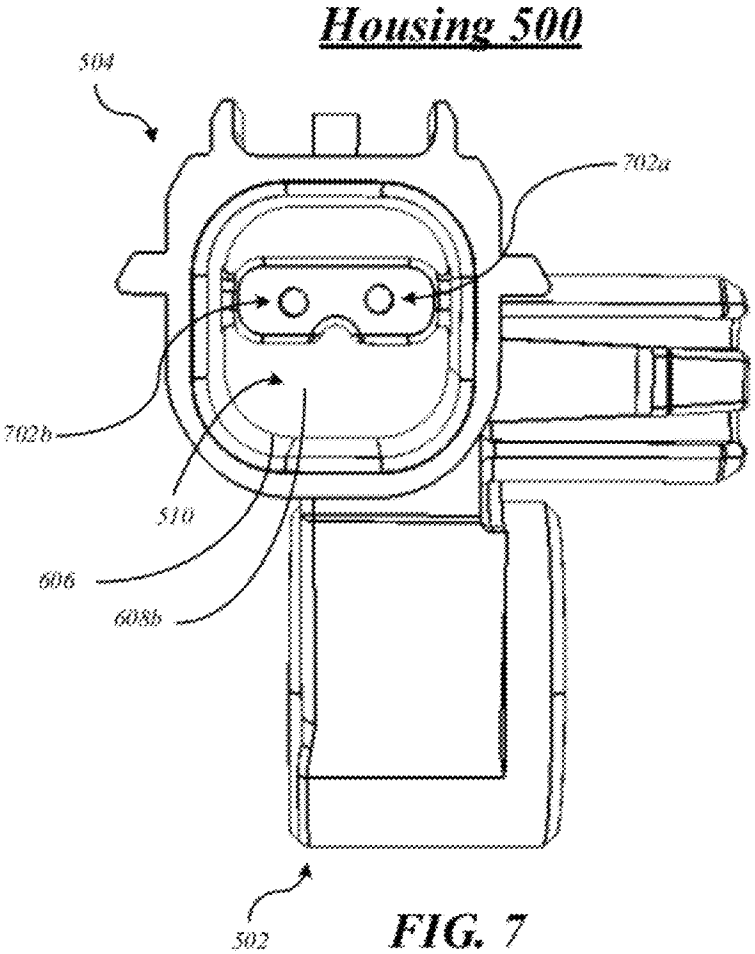
FIG. 7 illustrates a front perspective view of satellite housing.

FIG. 7 illustrates a front perspective view of the satellite housing 500 showing more detail for the aperture 510. As shown, the aperture 510 may form a roughly rectangular shape and may have apertures 702*a*, 702*b* sized to receive the respective pin portions 120*a*, 120*b* of the respective electrical connectors 100*a*, 100*b*. In one embodiment, the apertures 702*a*, 702*b* may correspond to the respective apertures 604*a*, 604*b* with a tunnel between each of the apertures 604*a*, 702*a* and 604*b*, 702*b*. The aperture 510 may be aligned with an axis for the pin portions 120*a*, 120*b* for automatically orienting the pin portions 120*a*, 120*b* for electrical interconnection with a communications medium for a vehicle monitoring system.

Similar to the aperture 508 of the satellite housing 500 as shown in FIG. 6, the aperture 510 of the satellite housing 500 as shown in FIG. 7 may further show one side 608*b* of the electrical connector interface portion 606 for the satellite housing 500 arranged to hold or encapsulate a portion of the electrical connector 100, such as the housing interface portion 130 connecting the capture portion 110 and the pin portion 120 of the electrical connector 100. It is worthy to note that the satellite housing 500 as shown in FIG. 7 illustrates the satellite housing 500 as it would look without the electrical connectors 100*a*, 100*b*, and merely has a pair of apertures 702*a*, 702*b* indicating respective positions for the electrical connectors 100*a*, 100*b* inserted before, during or after manufacture of the satellite housing 500.

Figure 8:
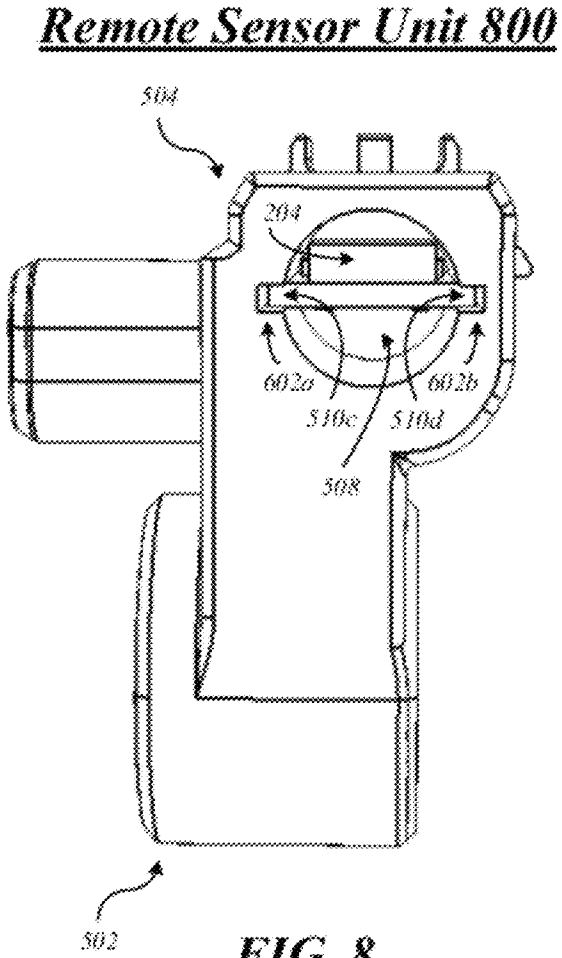
FIG. 8 illustrates a rear perspective view of a remote sensor unit.

FIG. 8 illustrates a rear perspective view of a remote sensor unit 800. The remote sensor unit 800 may comprise the satellite housing 500, the electrical connectors 100*a*, 100*b* disposed within the satellite housing 500, and the electronic component 202 electrically coupled to the capture portions 110*a*, 110*b* and encapsulated within the aperture 508. FIG. 8 illustrates a configuration where the electronic component 202 has been inserted into the aperture 508 and electrically connected to the capture portions 110*a*, 110*b* exposed at one end of the aperture 508. During insertion, the pair of opposing notches 602*a*, 602*b* may receive the respective side edges 210*c*, 210*d* of the electronic component 202 and act as guides to orient the electronic component 202 so that the front edge 210*a* enters gaps 116*a*, 116*b* to properly seat in the capture portions 110*a*, 110*b*. The aperture 508 may be sealed once the electronic component 202 has been fully inserted into the aperture 508. Alternatively, the aperture 508 may remain unsealed.

Figure 9:
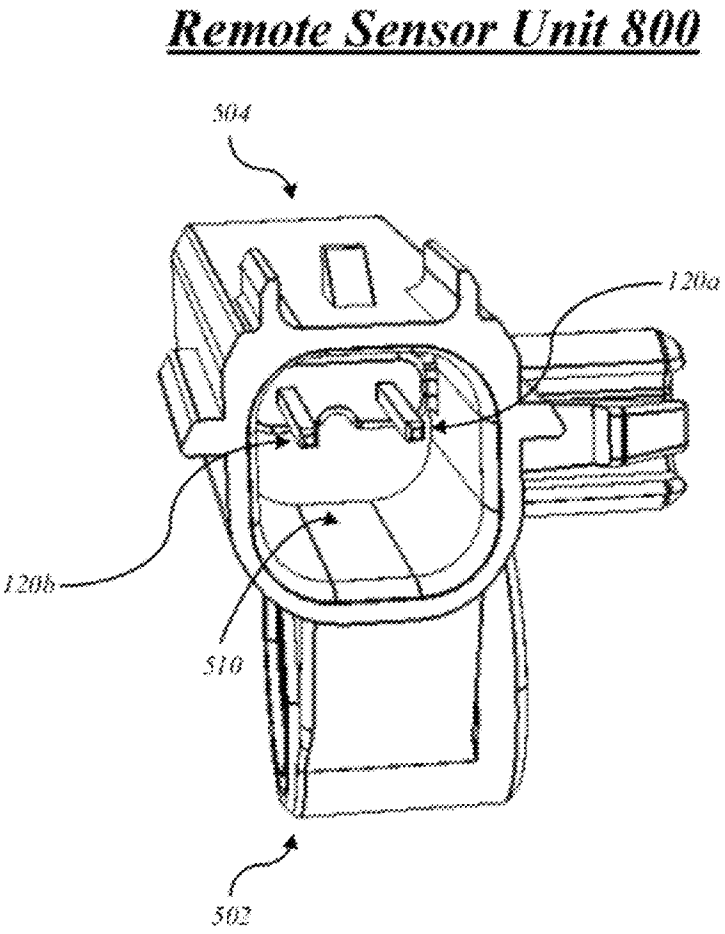
FIG. 9 illustrates a front perspective view of a remote sensor unit.

FIG. 9 illustrates a front perspective view of the remote sensor unit 800. FIG. 9 illustrates a configuration where the electrical connectors 100*a*, 100*b* have been inserted or manufactured into the satellite housing 500 and the electrical connector interface portion 606 of the satellite housing 500 securely holds the housing interface portions 130*a*, 130*b* of the electrical connectors 100*a*, 100*b*. As shown, the pin portions 120*a*, 120*b* of the respective electrical connectors 100*a*, 100*b* are exposed within the aperture 510 to allow for electrical connection to a vehicle monitoring system or other electronic system for a vehicle. Once the electrical connectors 100*a*, 100*b* are disposed within the satellite housing 500, the aperture 510 remains unsealed to provide access to the pin portions 120*a*, 120*b* until connected to the vehicle monitoring system.

Figure 10:
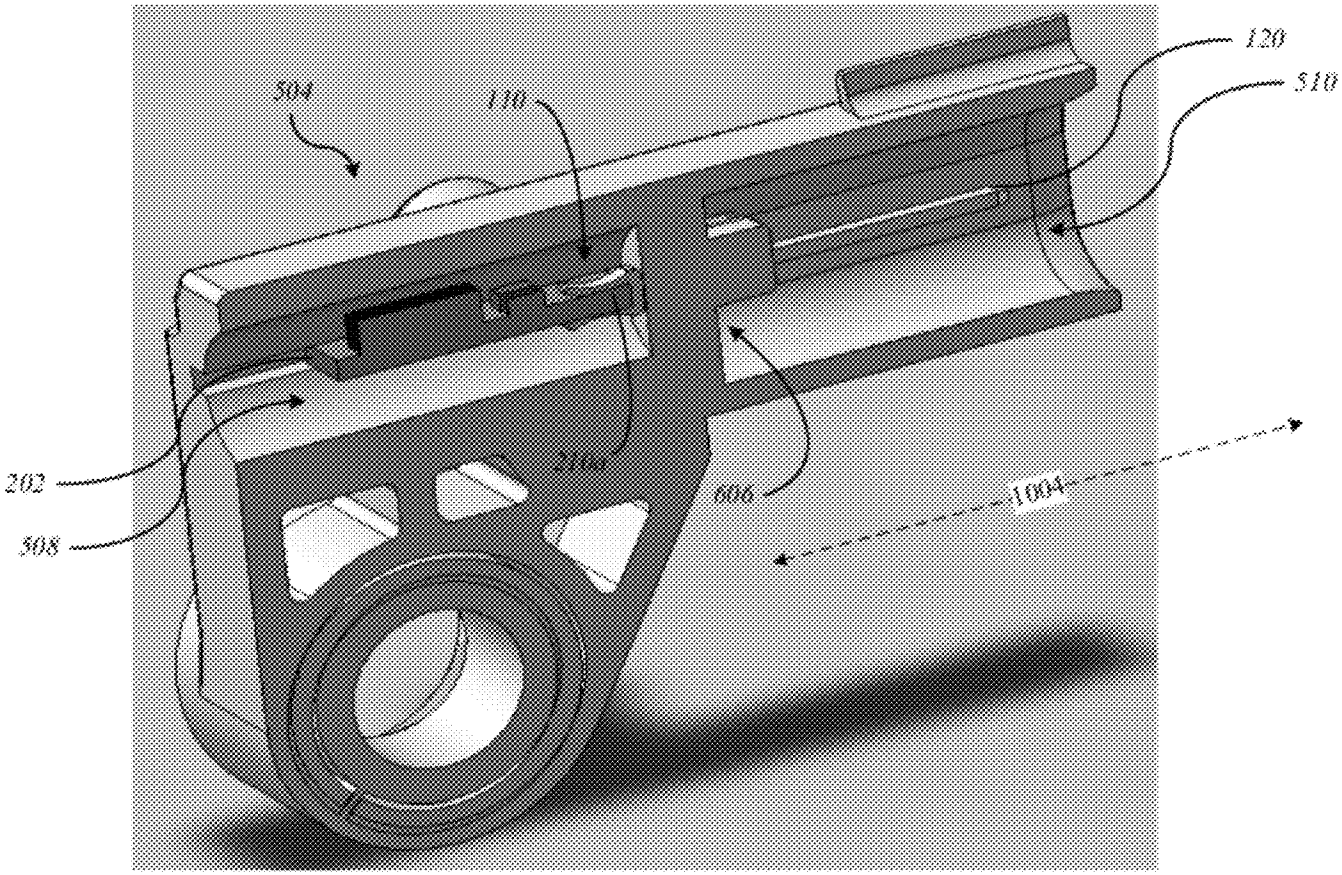
FIG. 10 illustrates a side section perspective view of a remote sensor unit.

FIG. 10 illustrates a side section perspective view of the remote sensor unit 800. FIG. 10 illustrates a cut-away view of the electronic component 202 as inserted into the aperture 508 of the satellite housing 500 and the front edge 210*a* fully seated within the capture component 110 of the electrical connector 100. FIG. 10 also illustrates the pin portion 120 exposed within the aperture 510 of the satellite housing 500, with the aperture 510 and the pin portion 120 aligned along an axis 1004 for automatically orienting the pin portion 12 for electrical interconnection with a communications medium for a vehicle monitoring system. FIG. 10 further illustrates a side view of the electrical connector interface portion 606 when encapsulating the housing interface portion 130 of the electrical connector 100.

Figure 11:
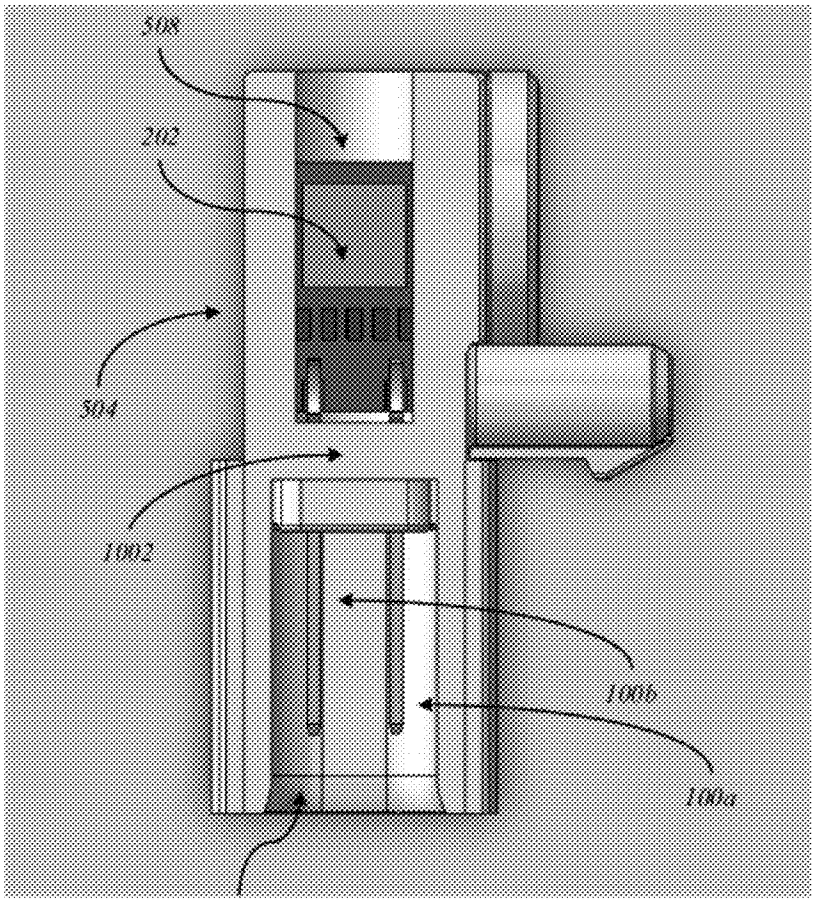
FIG. 11 illustrates a top section perspective view of a remote sensor unit.

FIG. 11 illustrates a top section perspective view of a remote sensor unit 800. FIG. 11 illustrates a cut-away view of the electronic component 202 as inserted into the aperture 508 of the satellite housing 500 and the front edge 210*a* fully seated within the capture components 110*a*, 110*b* of the respective electrical connectors 100*a*, 100*b*. FIG. 11 further illustrates a top view of the electrical connector interface portion 606 when encapsulating the housing interface portion 130 of the electrical connector 100.

Figure 12:
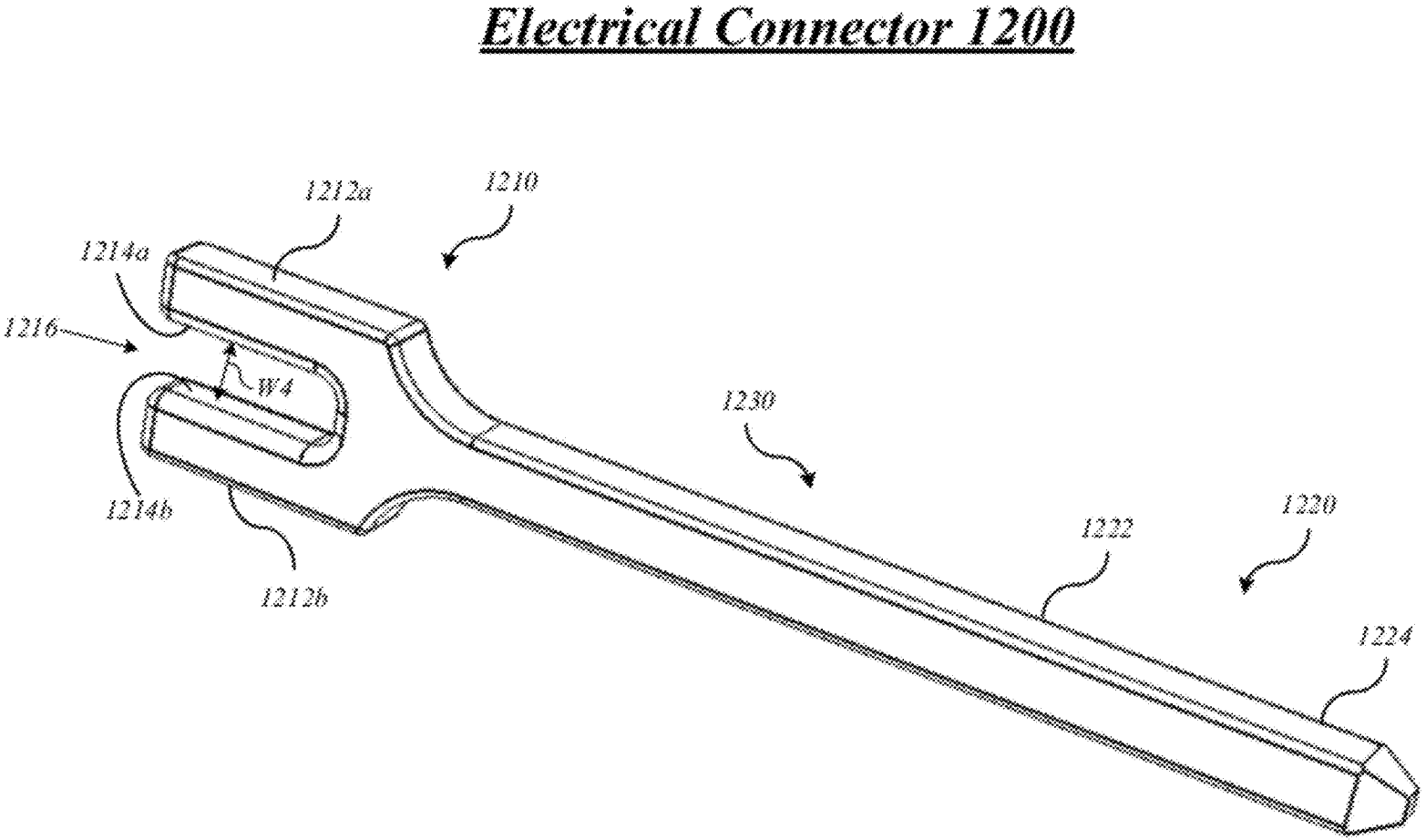
FIG. 12 illustrates a perspective view of a second electrical connector.

FIG. 12 illustrates a perspective view of an electrical connector 1200. The electrical connector 1200 may be similar to the electrical connector 100. However, there are some differences. Unlike the electrical connector 100 having the pair of opposing mechanical contact elements 112*a*, 112*b* formed with curved surfaces adapted to receiving an edge 210*a*, 210*b*, 210*c* or 210*d* of the electronic component 202, the electrical connector 1200 has a pair of opposing mechanical contact elements 1212*a*, 1212*b* of a capture portion 1210 with straight surfaces. As shown, the first opposing mechanical contact element 1212*a* may have a first straight surface and the second opposing mechanical contact element 1212*b* may have a second straight surface. The first and second straight surfaces may be substantially parallel to each other. As such, the straight and parallel surfaces of the pair of opposing mechanical contact elements 1212*a*, 1212*b* may form a gap 1216 of uniform gap width W4. The uniform gap width W4 may be slightly larger than the width W3 for an edge 210*a*, 210*b*, 210*c* or 210*d* of the electronic component 202. This reduces an amount of force needed to insert an edge 210*a*, 210*b*, 210*c* or 210*d* of the electronic component 202 into the gap 1216 relative to the curved surfaces of the pair of opposing mechanical contact elements 112*a*, 112*b* of the electrical connector 100. However, retention capabilities of a seated electronic component 202 may be less than the curved surfaces embodiment.

Furthermore, the electrical connector 1200 may have a housing interface portion 1230 similar to the housing interface portion 130 of the electrical connector 100. However, the electrical connector 1200 does not have extensions 136*a*, 136*b*. Rather, the housing interface portion 1230 has a uniform surface with that of a pin portion 1220. Removal of the extensions 136*a*, 136*b* allows the electrical connector 1200 to be directly inserted into the apertures 604*a*, 604*b* of the electrical connector interface portion 606 for the satellite housing 500 after the satellite housing has been manufactured, thereby removing the manufacturing complexities associated with positioning and encapsulating the electrical connector 1200 within the electrical connector interface portion 606 during the injection molding process for the satellite housing 500.

Figure 13:
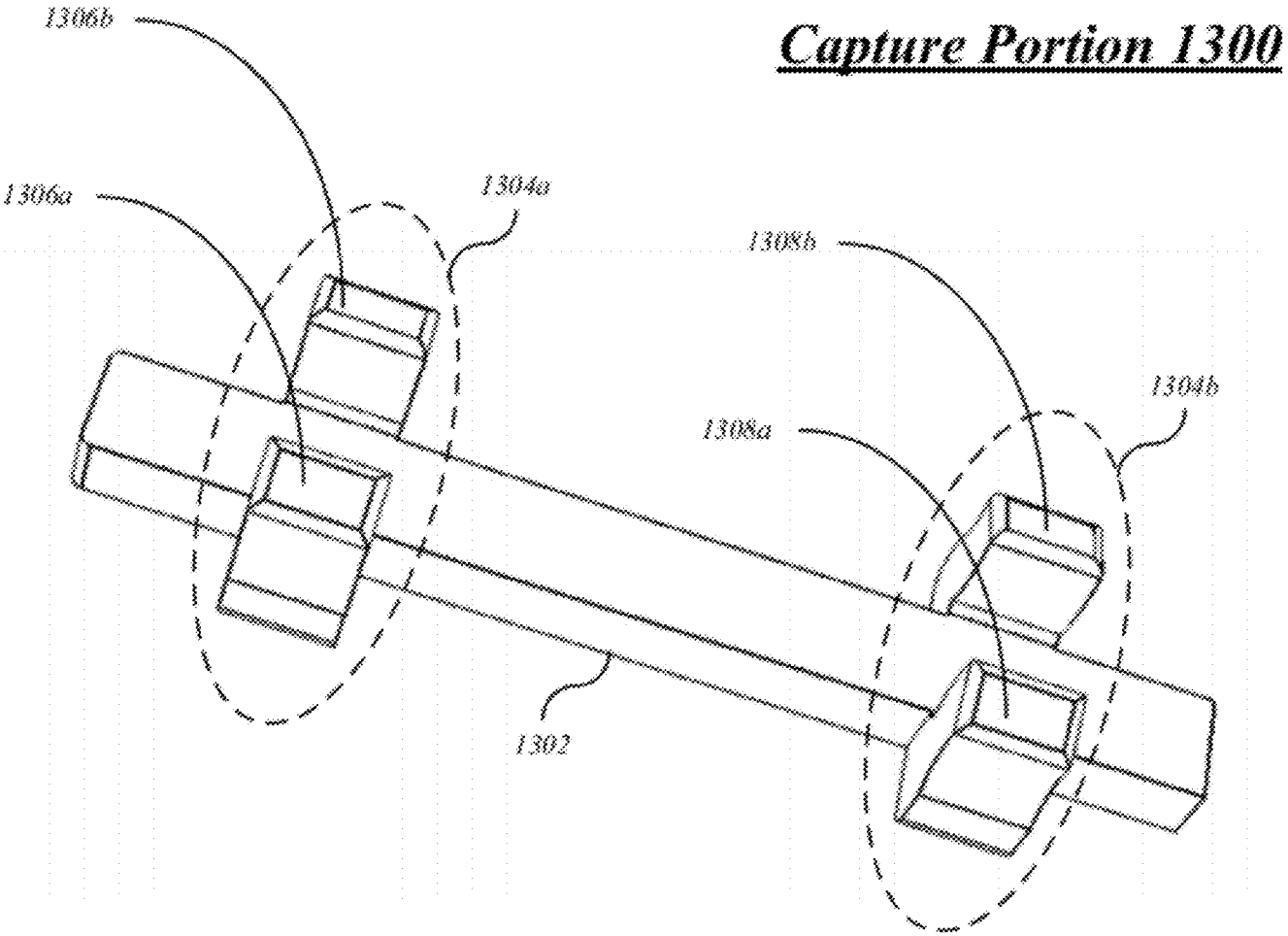
FIG. 13 illustrates a perspective view of a capture portion.

FIG. 13 illustrates a perspective view of a capture portion 1300 suitable for use with an electrical connector, such as a modified electrical connector 100 or 1200. For instance, rather than the electrical connector 100 (or the electrical connector 1200) having the capture portion 110 designed to receive a front edge 210*a* of the electronic component 202, the electrical connector 100 (or the electrical connector 1200) may be modified to remove the capture portion 110 and instead utilize the capture portion 1300 arranged to receive a side edge 210*c* or 210*d* of the electronic component 202.

As shown in FIG. 13, the capture portion 1300 may have one or more edge retention portions 1304*a*, 1304*b*. In one embodiment, for example, the capture portion 1300 may include the first edge retention portion 1304*a* having a first pair of opposing mechanical contact elements 1306*a*, 1306*b* arranged to receive a first portion of a side edge 210*c* and/or 210*d* of the electronic component 202. The capture portion 1300 may further include the second edge retention portion 1304*b* having a second pair of opposing mechanical contact elements 1308*a*, 1308*b* arranged to receive a second portion of the side edge 210*c* and/or 210*d* of the electronic component 202. It may be appreciated that the capture portion 1300 may have more or less edge retention portions as desired for a given implementation. The embodiments are not limited in this respect.

As with the capture portion 110, one or both of the opposing mechanical contact elements from each of the first and second pairs of opposing mechanical contact elements may comprise an electrical contact element to contact and electrically connect to a corresponding electrical contact element formed on a surface of the electronic component 202. The electronic component 202 may be modified so that the contact elements are moved from the front edge 210*a* to one or both of the side edges 210*c*, 210*d* of the electronic component 202 to correspond to the electrical contact elements of the electronic component 202.

The capture portion 1300 provides enhanced mechanical stability for capturing and holding the electronic component 202. Furthermore, the capture portion 1300 allows for multiple electrical contact elements thereby enhancing electrical signaling and/or increasing a number of electrical components implemented for the electronic component 202.

Figures 14A, 14B, 14C:
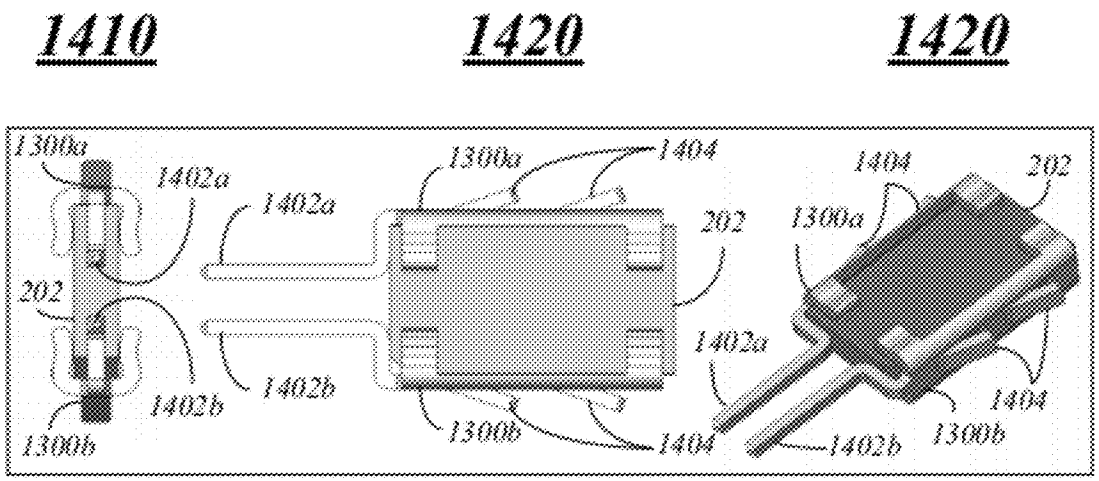
FIG. 14A illustrates a front perspective view of a second electronic assembly.
FIG. 14B illustrates a top perspective view of a third electronic assembly.
FIG. 14C illustrates a side perspective view of the third electronic assembly.

FIG. 14A illustrates a front perspective view of an electronic assembly 1410. The electronic assembly 1410 may comprise a set of electrical connectors 100*a*, 100*b* and/or a set of electrical connectors 1200*a*, 1200*b* modified with a respective capture portions 1300*a*, 1300*b* and connected to an electronic component 202. As shown, the capture portion 1300*a* may hold one side of the electronic component 202 (e.g., side edge 210*c*) while the capture portion 1300*b* may hold another side of the electronic component 202 (e.g., side edge 210*d*). The modified electrical connectors may include pin portions 1402*a*, 1402*b* to output data signals to a vehicle safety system.

FIG. 14B illustrates a top perspective view of an electronic assembly 1420. The electronic assembly 1420 may be similar to the electronic assembly 1410 described with reference to FIG. 14A. In addition, the electronic assembly 1420 may further include one or more angled members 1404 to assist in retaining the electronic assembly within the aperture 508 of the satellite housing 500. As shown, the capture portions 1300*a*, 1300*b* may have at least one angled member 1404 oriented to allow movement of the electrical connector when connected to the electronic component 202 in a first direction and not a second direction opposite to that of the first direction. The first direction may comprise a direction into the aperture 508 towards the side 608*a* of the electrical connector interface portion 606 for the satellite housing 500, while the second direction may comprise a direction out of the aperture 508 away from the side 608*a* of the electrical connector interface portion 606 for the satellite housing 500, for example.

FIG. 14C illustrates a side perspective view of a the electronic assembly 1420. FIG. 14C provides a more distinct view of the angled members 404 of the capture portion 1300*b*. The angled members 404 may flex slightly to allow movement along the sides of the aperture 508 during insertion of the electronic assembly 1420 into the aperture 508. The angled members 404 may catch the sides of the aperture 508 during attempted removal of the electronic assembly 1420 from the aperture 508. This arrangement allows insertion of the electronic assembly 1420 into the satellite housing 500 after it has been manufactured, while enhancing retention properties of the electronic assembly 1420 once inserted into the aperture 508 of the satellite housing.

Figure 15:
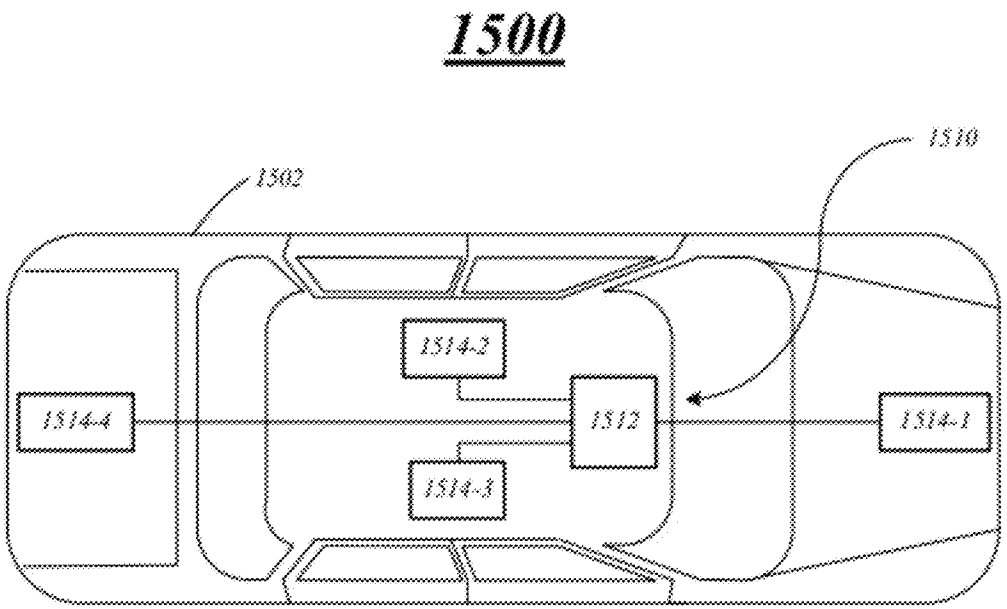
FIG. 15 illustrates an embodiment of an operating environment.

FIG. 15 illustrates an embodiment of an operating environment 1500. The operating environment 1500 may comprise a motor vehicle 1502 having a vehicle monitoring system 1510 for the motor vehicle 1502. In one embodiment, for example, the vehicle monitoring system 1510 may be implemented as a vehicle safety system. Although some embodiments are described with reference to a vehicle safety system, such as the vehicle monitoring system 1510, it may be appreciated that other embodiments may be used with any type of monitoring system useful for the motor vehicle 1502. Examples of monitoring systems may include without limitation vehicle safety systems, vehicle performance systems, vehicle control systems, vehicle testing systems, and any other monitoring systems suitable for use with electronic sensors. The embodiments are not limited in this context.

The vehicle monitoring system 1510 may comprise, or be implemented as, any safety system utilizing remote sensor units and suitable for the motor vehicle 1502. Vehicle monitoring system 1510 may comprise both active and passive safety devices and systems. Examples of vehicle safety systems 1510 may include without limitation crash avoidance systems, driver assistance systems, crash detection systems (or crashworthiness systems), and other vehicle safety systems. Further examples of vehicle safety systems 1510 may comprise without limitation seatbelt pretensioner systems, airbag systems, occupant restraint system, infrared night vision systems to increase seeing distance beyond headlamp range, tire pressure monitoring systems or deflation detection systems, reverse backup sensors which alert drivers to difficult-to-see objects in their path when reversing, backup cameras, lane departure warning systems to alert the driver of an unintended departure from the intended lane of travel, traction control systems which restore traction if driven wheels begin to spin, electronic stability control which intervenes to avert an impending loss of control, anti-lock braking systems, electronic brakeforce distribution systems, emergency brake assist systems, cornering brake control systems, adaptive headlamps swivels headlamps around corners, automatic high beams which automatically adapts the headlamp range to the distance of vehicles ahead or which are oncoming, adaptive cruise control which maintains a safe distance from the vehicle in front, precrash systems, automated parking systems, among others. The embodiments are not limited in this context.

In the illustrated embodiment shown in FIG. 15, the vehicle monitoring system 1510 may comprise one or more remote sensor units 1514-*m*, where m represents any positive integer. The remote sensor units 1514-*m* may be implemented as one or both of the remote sensor units 200, 400 having the electronic assembly 100. The remote sensor units 1514-*m* may be located throughout the motor vehicle 1502. For example, possible front locations for the remote sensor units 1514-*m* may include a radiator support or front bumper, possible side locations for the remote sensor units 1514-*m* may include door pillars between the doors, and possible rear locations for the remote sensor units 1514-*m* may include a rear bumper. Other locations are possible. The remote sensor units 1514-*m* may be bolted to the motor vehicle 1502 (e.g., the vehicle frame) via the fastening portions of the satellite housing 500, or directly molded into vehicle parts or components The vehicle monitoring system 1510 may also have a controller 1512 connected to the pin portions 120*a*, 120*b* of the sensor assembly 100 (or sensor assembly 1200 or sensor assemblies 100, 1200 modified with the capture portion 1300). The controller 1512 may be operative to receive data from the electronic sensor 204 and use the data to determine whether to activate a safety system for the motor vehicle 1502. The controller 1512 may comprise, or be implemented as, a part of an electronic control unit (ECU) or airbag control unit (airbag control unit) for the vehicle monitoring system 1510. The controller 1512 and/or the ECU and/or the airbag control unit may be enclosed in a metal housing for protection, and bolted somewhere to the motor vehicle 1502 (e.g., the vehicle frame). In some instances, the controller 1512 may be implemented as part of a remote sensor unit 1514-*m*, or may itself be a remote sensor unit 1514-*m*.

In one embodiment, for example, the vehicle monitoring system 1510 may comprise multiple remote sensor units 1514-*m* each with the pin portions 120*a*, 120*b* connected to the controller 1512. The controller 1512 may be operative to receive multiple sets of data from the electronic sensors 204 and use the multiple sets of data to determine whether to deploy a safety system for a vehicle. For instance, the vehicle monitoring system 1510 may be implemented as a crash detection system and the remote sensor units 1514-*m* may be impact or crash detection sensors. The vehicle monitoring system 1510 may monitor and collect data from the remote sensor units 1514-*m* by the controller 112 which is implemented as part of an airbag control unit. The airbag control unit may calculate an angle of impact, severity and force of an impact to determine whether to deploy one or more airbag stages. It may be appreciated that this is merely one example for the vehicle monitoring system 1510 and the remote sensor units 1514-*m*, and other implementations are possible as well. The embodiments are not limited in this context.

Various embodiments, such as the electronic component 202 and electronic sensor 204 of the electronic assembly 200, may be implemented using hardware elements, software elements, or a combination of both. Examples of hardware elements may include devices, components, processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), memory units, logic gates, registers, semiconductor device, chips, microchips, chip sets, and so forth. For instance, the electronic component 202 may include various processors and communications interfaces, including wired or wireless communications interfaces. Examples of wireless communications interfaces may include wireless transceivers or radios and supporting architecture (e.g., filters, baseband processors, antennas, and so forth). Examples of software elements may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints, as desired for a given implementation.

Some embodiments may be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

It is emphasized that the Abstract of the Disclosure is provided to comply with 37C.F.R. Section 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

a satellite housing having an electrical connector interface portion; and an electrical connector disposed within the electrical connector interface portion of the satellite housing, the electrical connector arranged to conduct electrical signals for an electronic component having an electronic sensor operative to monitor conditions for a vehicle, the electrical connector comprising a capture portion at a first end and a pin portion at a second end, the capture portion having a pair of opposing mechanical contact elements arranged to receive at least one edge of the electronic component, with at least one of the opposing mechanical contact elements comprising an electrical contact element to contact and electrically connect to an electrical contact element formed on a surface of the electronic component, and the pin portion having an electrical contact element to contact and electrically connect to a communications medium for a vehicle monitoring system, wherein the electrical connector interface portion of the satellite housing has an aperture with a geometry matching the pin portion of the electrical connector to allow the aperture to receive the pin portion when force is applied to the capture portion of the electrical connector.

2. The apparatus of claim 1, the satellite housing having a fastener portion and an interface portion, the fastener portion having an aperture for receiving a fastener to mount the satellite housing to a vehicle, the interface portion having a first aperture to expose the capture portion of the electrical connector and a second aperture to expose the pin portion of the electrical connector.

3. The apparatus of claim 2, the first aperture forming a cylinder with a pair of opposing notches sized to receive a pair of side edges of the electronic component, the pair of opposing notches oriented to guide the electronic component in an axial direction aligned with an axis for the pin portion to allow the front edge of the electronic component to enter a gap formed between the pair of opposing mechanical contact elements of the capture portion when forced is applied to a back edge of the electronic component.

4. The apparatus of claim 2, the second aperture aligned with an axis for the pin portion for automatically orienting the pin portion for electrical interconnection with a communications medium for a vehicle monitoring system.

5. The apparatus of claim 1, the pin portion comprising a pin having an electrical contact element to contact and electrically connect to an electrical contact element for a vehicle monitoring system.

6. The apparatus of claim 1, the capture portion at the first end and the pin portion at the second end connected by a housing interface portion, the housing interface portion comprising a first side having a first side surface and a second side having a second side surface, the first side having a first extension with a first extension surface in a different plane from the first side surface, and the second side having a second extension with a second extension surface in a different plane from the second side surface.

7. The apparatus of claim 6, the electrical connector interface portion of the satellite housing encapsulating the housing interface portion of the electrical connector when the satellite housing is created.

8. The apparatus of claim 1, the pair of opposing mechanical contact elements of the capture portion having a first opposing mechanical contact element and a second opposing mechanical contact element, the first opposing mechanical contact element having a first curved surface and the second opposing mechanical contact element having a second curved surface, the first and second curved surfaces curving away from each other.

9. The apparatus of claim 1, the pair of opposing mechanical contact elements of the capture portion having a first opposing mechanical contact element and a second opposing mechanical contact element, the first opposing mechanical contact element having a first straight surface and the second opposing mechanical contact element having a second straight surface, the first and second straight surfaces substantially parallel to each other.

10. The apparatus of claim 1, the capture portion comprising a first edge retention portion having a first pair of opposing mechanical contact elements arranged to receive a first portion of a side edge of the electronic component, and a second edge retention portion having a second pair of opposing mechanical contact elements arranged to receive a second portion of the side edge of the electronic component.

11. The apparatus of claim 10, with at least one of the opposing mechanical contact elements from each of the first and second pairs of opposing mechanical contact elements comprising an electrical contact element to contact and electrically connect to an electrical contact element formed on a surface of the electronic component.

12. The apparatus of claim 10, the capture portion having at least one angled member oriented to allow movement of the electrical connector when connected to the electronic component in a first direction and not a second direction opposite to that of the first direction.

13. A remote sensor unit, comprising:

an electronic component comprising an electronic sensor arranged to monitor conditions for a vehicle;

a satellite housing arranged to encapsulate a portion of the electronic component, the satellite housing having an electrical connector interface portion; and an electrical connector disposed within the electrical connector interface portion of the satellite housing, the electrical connector arranged to conduct electrical signals for the electronic component, the electrical connector comprising a capture portion at a first end and a pin portion at a second end, the capture portion having a pair of opposing mechanical contact elements arranged to receive a front edge of the electronic component, with at least one of the opposing mechanical contact elements comprising an electrical contact element to contact and electrically connect to an electrical contact element formed on a surface of the electronic component, and the pin portion having an electrical contact element to contact and electrically connect to a communications medium for a vehicle monitoring system, wherein the electrical connector interface portion of the satellite housing has an aperture with a geometry matching the pin portion of the electrical connector to allow the aperture to receive the pin portion when force is applied to the capture portion of the electrical connector.

14. The remote sensor unit of claim 13, the electronic component comprising a substrate having the electronic sensor mounted on one or both sides of the substrate.

15. The remote sensor unit of claim 13, the electronic sensor comprising an integrated circuit, and the electronic component comprising a printed circuit board having the integrated circuit mounted on one side of the printed circuit board.

16. The remote sensor unit of claim 13, the electronic sensor comprising an accelerometer, a decelerometer, an impact sensor, pressure sensor, a wheel speed sensor, a brake pressure sensor, a seat occupancy sensor, a crush zone sensor, a temperature sensor or a gyroscope.

17. The remote sensor unit of claim 13, the electronic sensor arranged to monitor conditions for a vehicle and output data signals to a vehicle monitoring system.

18. A vehicle monitoring system, comprising:

a remote sensor unit, comprising:

an electronic component comprising an electronic sensor arranged to monitor conditions for a vehicle;

a satellite housing arranged to encapsulate a portion of the electronic component, the satellite housing having an electrical connector interface portion;

an electrical connector disposed within the electrical connector interface portion of the satellite housing, the electrical connector arranged to conduct electrical signals for the electronic component, the electrical connector comprising a capture portion at a first end and a pin portion at a second end, the capture portion having a pair of opposing mechanical contact elements arranged to receive a front edge of the electronic component, with at least one of the opposing mechanical contact elements comprising an electrical contact element to contact and electrically connect to an electrical contact element formed on a surface of the electronic component, and the pin portion having an electrical contact element to contact and electrically connect to a communications medium for the vehicle monitoring system; and a controller for the vehicle monitoring system connected to the communications medium, the controller operative to receive data from the electronic sensor and use the data to determine whether to activate a system for a vehicle, wherein the electrical connector interface portion of the satellite housing has an aperture with a geometry matching the pin portion of the electrical connector to allow the aperture to receive the pin portion when force is applied to the capture portion of the electrical connector.

19. The vehicle monitoring system of claim 18, the system comprising a vehicle safety system, a vehicle performance system, a vehicle control system or a vehicle testing system.

* * * * *